US007448564B2

(12) United States Patent
Niemela et al.

(10) Patent No.: US 7,448,564 B2
(45) Date of Patent: Nov. 11, 2008

(54) PORTABLE APPARATUS FOR CRUSHING ROCK AND OTHER HARD MATERIAL AND RELATED METHOD

(75) Inventors: Robert Niemela, Ontoagon, MI (US); Carl Kieranen, Chassell, MI (US)

(73) Assignee: New Dimension Crushers, LLC, Ontonagon, MI (US)

( * ) Notice: Subject to any disclaimer, the term of this patent is extended or adjusted under 35 U.S.C. 154(b) by 173 days.

(21) Appl. No.: 11/197,807

(22) Filed: Aug. 4, 2005

(65) Prior Publication Data

US 2007/0029422 A1 Feb. 8, 2007

(51) Int. Cl.

| | |
|---|---|
| ***B02B 5/02*** | (2006.01) |
| ***B02C 1/10*** | (2006.01) |
| ***B02C 9/04*** | (2006.01) |
| ***B02C 19/00*** | (2006.01) |
| ***B03B 7/00*** | (2006.01) |

(52) U.S. Cl. ..... 241/101.2; 241/241.5

(58) Field of Classification Search ..... 241/241.5, 241/101.2, 207, 208, 210

See application file for complete search history.

(56) References Cited

U.S. PATENT DOCUMENTS

| | | | | | |
|---|---|---|---|---|---|
| 2,318,039 | A | * | 5/1943 | Wood | 241/217 |
| 2,409,391 | A | * | 10/1946 | Rumpel | 241/208 |
| 2,582,734 | A | * | 1/1952 | Adams | 241/142 |
| 2,598,942 | A | * | 6/1952 | Rumpel | 241/217 |
| 3,219,287 | A | * | 11/1965 | Weiss | 241/267 |
| 3,229,922 | A | * | 1/1966 | Weiss et al. | 241/204 |
| 3,235,190 | A | * | 2/1966 | Symons | 241/299 |
| 3,508,716 | A | * | 4/1970 | Daly | 241/204 |
| 3,894,698 | A | * | 7/1975 | Falk | 241/264 |
| 3,958,767 | A | | 5/1976 | Stiles | |
| 4,165,042 | A | | 8/1979 | Peterson | |
| 4,192,472 | A | * | 3/1980 | Johnson | 241/215 |
| 4,288,039 | A | | 9/1981 | Waskow | |
| 4,288,040 | A | | 9/1981 | Miller | |
| 4,382,560 | A | * | 5/1983 | Toole | 241/101.2 |
| 4,607,799 | A | * | 8/1986 | Currie | 241/101.72 |
| 4,844,362 | A | * | 7/1989 | Revnivtsev et al. | 241/210 |
| 4,899,942 | A | | 2/1990 | Bohringer | |
| 4,909,128 | A | | 3/1990 | Grinwald | |

(Continued)

FOREIGN PATENT DOCUMENTS

EP 93069 A2 * 11/1983

*Primary Examiner*—Bena Miller
(74) *Attorney, Agent, or Firm*—Brooks Kushman P.C.

(57) ABSTRACT

The invention includes a rock crushing machine and method, the machine having a base and a jaw assembly secured to the base. The jaw assembly is adapted to receive rock as input material to be at least partially crushed. The jaw assembly is provided with an arcuate reaction surface that progressively engages the input material. A hollow crushing roll has an axial inner chamber that has an axis of symmetry (O). The crushing roll is a driven member that has an outside surface which forms a crushing zone between it and the reaction surface of the jaw assembly. Positioned at least partially within the crushing roll, an eccentric shaft serves as a driving member. The eccentric shaft has an axis of rotation (E), that axis being displaced from the axis (O) by a distance (T). A drive mechanism is coupled to the eccentric shaft so that as the eccentric shaft turns, rotational and centrifugal forces can be transmitted to the crushing roll by a torque transmitting device or other roll drive torque biasing mechanism.

14 Claims, 8 Drawing Sheets

U.S. PATENT DOCUMENTS 5,054,958 A 10/1991 Strunk
5,172,869 A 12/1992 Kitsukawa et al.
5,312,053 A * 5/1994 Ganser, IV ..... 241/30
5,482,218 A * 1/1996 Ha ..... 241/30
5,718,391 A * 2/1998 Musil ..... 241/220
5,931,394 A * 8/1999 Haven et al. ..... 241/30
6,213,418 B1 * 4/2001 Gabriel et al. ..... 241/207
6,446,892 B1 9/2002 Fasoli et al.
2003/0132328 A1 7/2003 Musil

* cited by examiner

PORTABLE APPARATUS FOR CRUSHING ROCK AND OTHER HARD MATERIAL AND RELATED METHOD

BACKGROUND OF THE INVENTION

1. Field of the Invention

The invention relates to mechanized rock crushers and more specifically to a crushing apparatus and method that portably handles reclamation, construction and mining tasks, among other industrial applications.

2. Background Art

Generally stated, a rock crusher is a machine designed to take relatively large rocks as input and produce smaller rocks or rock dust as output. Such machines are often deployed to produce rock fill material for such uses as landscaping and erosion control. Rock crushing machines are typically large, very noisy, and produce a considerable quantity of unwanted dust. Most rock crushing machine installations are therefore in rural areas, away from population centers, and always from where the crushed materials are most needed.

While there are prior art crushers which are adequate for the basic purpose and function for which they have been specifically designed, they tend to be deficient in that they generally fail to provide a relatively efficient, low horsepower, compact crusher that is also practical for other small scale applications apart from traditional mining requirements. Typical rock crushing machines which are capable of reasonable rates of production, tend to be prohibitively large, bulky, and expensive. Most notably, their size, weight, and the horsepower requirements make them expensive and difficult to move crushing operations from one location to another.

It has been observed within the industry that "No crusher has ever been devised that will produce only material exceeding a certain minimum size. There is produced always a substantial portion of material that is crushed to fine for the purposes at hand . . . This explains in part why crushing machines, especially those designed for crushing effectiveness . . . are very rugged and massive." Gaudin, A. M., *Principles of Mineral Dressing*, p. 5 (McGraw-Hill, 1939).

Within the state of the art, rock crushing machinery is relatively immobile, usually requiring massive foundations and/or dead weight for stability, usually requiring massive foundations. High costs for haulage and related transport equipment are usually entailed. Crushing relatively small amounts of rock or demolition waste in areas even a short distance from existing crushing plants or installations usually cannot be economically justified. Significant value could be realized with the development of a means to economically crush rock, construction and demolition materials at their source, and in the various quantities that are available and needed.

It has been estimated that approximately ten tons of processed aggregate are produced annually for every man, woman and child in the United States. Land fill volume nationwide includes about 15% of recyclable inorganic material, such as brick and concrete. These materials could be recycled if they were to be economically comminuted on site. Together, these material resources offer opportunities representing huge markets that are ready for technical advancement, innovation, and cost savings.

Rocks may be considered, from the viewpoint of communition to fall into two structural types: homogeneous and heterogeneous. In structurally homogeneous rocks, fracture occurs through mineral grains and along the grain boundaries. Heterogeneous rocks are those in which fracture planes occur only along the grain boundaries. Crushed heterogeneous rock tends to have a greater proportion of particle size near the average grain size than is obtained from structurally homogeneous rocks. Cracks occur when the rock is subjected to external forces which, if sufficient, cause the rock to fracture. It would be desirable to have a fracturing mechanism that is so configured as to reduce the forces that are necessary to cause the rock to fracture. It is known that different closed sets of a jaw crusher generate distinct grade variations and that in general, a smaller closed set produces a greater degree of grade variation and finer particle size. C. W. Lai, et al., "EFFECTS OF GRAIN BOUNDARY FRACTURING ON GRADE VARIATION OF COMMINUTED SLAG", Trans. Inst. Min. Metall. 111, 307 (2002)

The types of prior art rock crushers include (1) impact crushers (e.g. hammer crushers, rotor impactors, vertical centrifugal impact crushers and cage mill crushers) and (2) compression crushers (e.g., jaw crushers, cone crushers, roll crushers, pen crushers, and gyratory crushers). The type of crusher that is best suited for a given job usually depends on the material to be crushed and the final application of the crushed material, together with maintenance and operational cost considerations. Other consideration factors may include power consumption, vibration, noise, and environmental issues.

Jaw crushers conventionally can handle hard rock, offer favorable reduction ratios, produce desired product characteristics at a reasonable throughput rate and are relatively economical to operate once they are put into place. (As used herein, the term "reduction ratio" refers to the ratio of the average size of raw material at the inlet to the average size of the finished product at the outlet.) But in mines and other locations that have restrictive space requirements, conventional crushers may be too wide or too tall, particularly if the input material is fed vertically downwardly. Another type of feed system, which differs from gravity fed configurations, is provided by horizontally mounted jaw crushers. In those configurations, a horizontal conveyor belt or feeder delivers input material to the lower edge of jaws in order to move material through the machine. Such a configuration however, tends to include a movement of finer material in a direction that opposes the major direction of throughput. This tends to result in a clogging or choking phenomenon. A rotary jaw crusher is described in U.S. Pat. No. 4,165,042. The horizontal feed feature described therein requires that all material must be fed to this unit at an angle of 45 to 50 degrees minimum from horizontal to meet the production requirements of commercial use. Further, conventional jaw crushers typically are not operated at high speed in order to avoid vibration problems propagated by moving jaw components. Such movements tend to cause balancing and vibrational problems.

Related difficulties are not limited to impact crushers. Compression crushers, for example, also are prone to excessive wear. If a region of a roll is worn, material to be crushed tends to be concentrated on the worn portion. If so, the wear rate of that portion tends to accelerate.

Rock crusher machine geometry conventionally defines the term "nip angle". This geometry relates to the ability to crush rock at a commercial rate. Some crushers built according to prior art tend to eject the materials being fed into the device from the machine, opposite the desired direction of material flow. This creates a noticeable level of inefficiency during the operation of the crushing machines of this design.

In underground mines, the maintenance of road beds can be expensive. The mine may operate conventional transports devices that move waste rock to the surface for handling by large scale crushers. The crushed material may then be returned back down the mine for grading and top dressing. It has been estimated that the typical cost is about $50-$100 per cubic yard. Accordingly, it would be desirable to handle the crushing operation underground, thereby producing a stockpile of material that is ready for applying to the road bed. One such machine is sold by Mining Technologies International Inc.'s (MTI) under the name "HydraCrusher." This device includes a bucket with a built-in, hydraulically-operated crushing mechanism. Adjustable jaws receive the coarse material. That unit is a fixed jaw and a moving jaw. There are external counterweights, which require guards for operator safety. Typical horsepower requirement may be of the order of 200-300 hp.

Other art identified in a search conducted before filing this patent application are the following U.S patent references: U.S. Pat. Nos. 3,958,767; 4,165,042; 4,288,039; 4,288,040; 4,899,942; 4,909,128; 5,054,958; 5,482,218; 6,446,892; and published application No. 2003/0132328 A1.

SUMMARY OF THE INVENTION

In light of the prior art, there exists a need for a new and improved portable rock crusher.

The invention includes a rock crushing machine and method, the machine having a base and a jaw assembly secured to the base. The jaw assembly is adapted to receive rock as input material to be at least partially crushed. The jaw assembly is provided with an arcuate reaction surface that progressively engages the input material.

A hollow crushing roll has an axial inner chamber that has an axis of symmetry (O). The crushing roll is a driven member that has an outside surface which forms a crushing zone between it and the reaction surface of the jaw assembly. Positioned at least partially within the crushing roll, an eccentric shaft serves as a driving member. The eccentric shaft has an axis of rotation (E), that axis being displaced from the axis (O) by a distance (T). A drive mechanism is coupled to the eccentric shaft so that as the eccentric shaft turns, rotational and centrifugal forces can be transmitted to the crushing roll by a torque converter or other roll drive torque biasing mechanism.

One purpose of this mechanism is to provide a means for driving the crushing roll generally in the same rotational direction as that of a an eccentric shaft while crushing operations are underway. This is accomplished without a direct mechanical drive or coupling and thus the efficiency of the crushing machine is greatly improved.

The invention also includes the development a nip angle of approximately 17 to 27 degrees causes the crushing forces exerted upon material to be comminuted to create a progressive and inward drawing action of material into the machine. Outside the desired range of nip angle for a given material type, a conventional rock and materials crushing machine performs suboptimally. Calculations of the desired geometry and nip angle ranges for the rock crushing machine components are therefore and herein described.

DETAILED DESCRIPTION OF THE PREFERRED EMBODIMENT(S)

Figure 1:
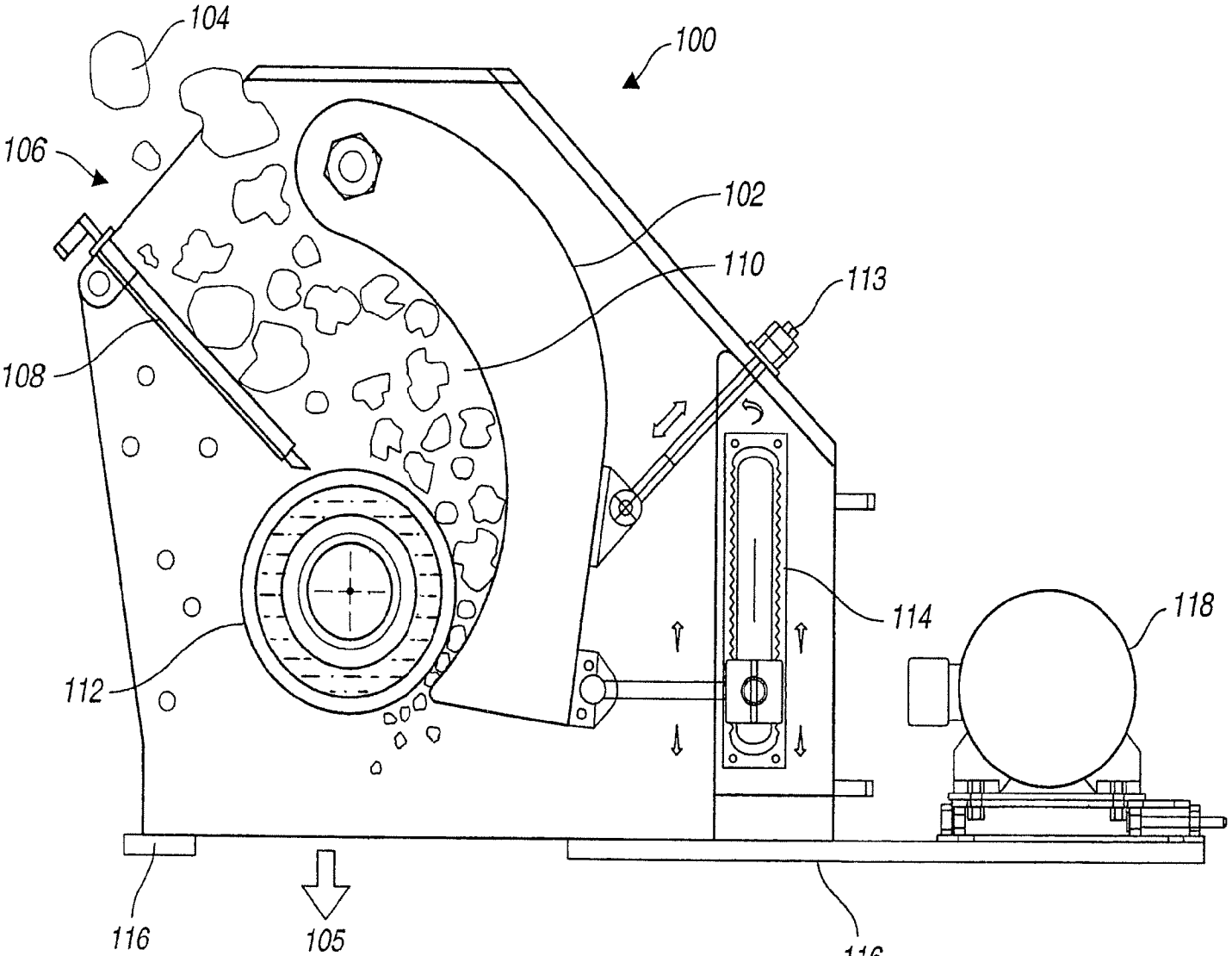
FIG. 1 is a side view of a rock crusher including the inventive components depicted herein.

Turning first to FIG. 1, there is depicted a side view of a rock crushing machine 100. As used herein, the term "rock" includes any hard material that could be crushed by the disclosed machine. Such material may include conventional rock, granite, limestone, sandstone, coal, walnuts, and the like. The machine includes a jaw assembly 102 that receives input material 104 to be comminuted through a feeder plate 106 that includes a hopper 108. Preferably, the hopper surface 108 can be oriented so that it is inclined up to about 50 degrees from horizontal.

The jaw has an arcuate reaction surface 110 that progressively engages the input material 104 between the reaction surface 110 and a crushing roll 112 that will be described in more detail.

The jaw assembly 102 includes a jaw tensioner 113 and a jaw adjustment mechanism 114. The jaw tensioner 113 includes threaded bolt or rods which can be lengthened or shortened by nuts at a distal end thereof. At a proximal end, there is a pivotal connection between the rod and the back of the jaw reaction surface 110. As illustrated, the jaw adjustment mechanism includes a threaded surface 114 which upon rotation causes a collar to slide upwardly and downwardly. A connection rod has a distal end attached to the collar and a proximal end which is pivotally connected to a lower region of the back of the reaction surface 110 of the jaw assembly 102. The jaw assembly 102 is rigidly and adjustably attached to a base 116, to which also a motor 118 is also secured. In the embodiment depicted, the motor 118 drives an eccentric shaft that is located inside the crushing roll 112.

Figure 2:
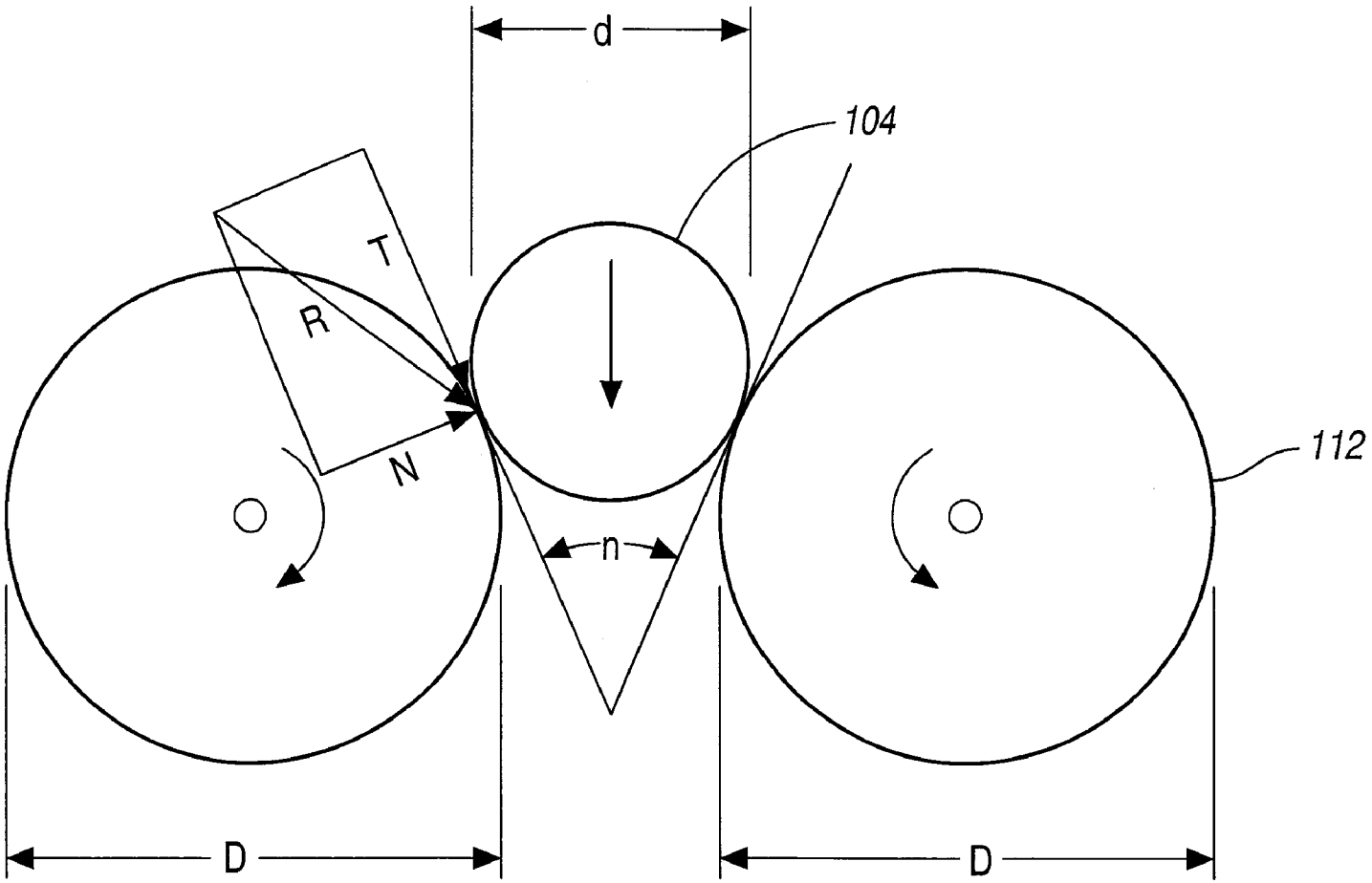
FIG. 2 is a diagram representing geometry used to define a crushing action.

In FIG. 2, the angle n is termed the "angle of nip" or "nip angle".

Figure 3C:
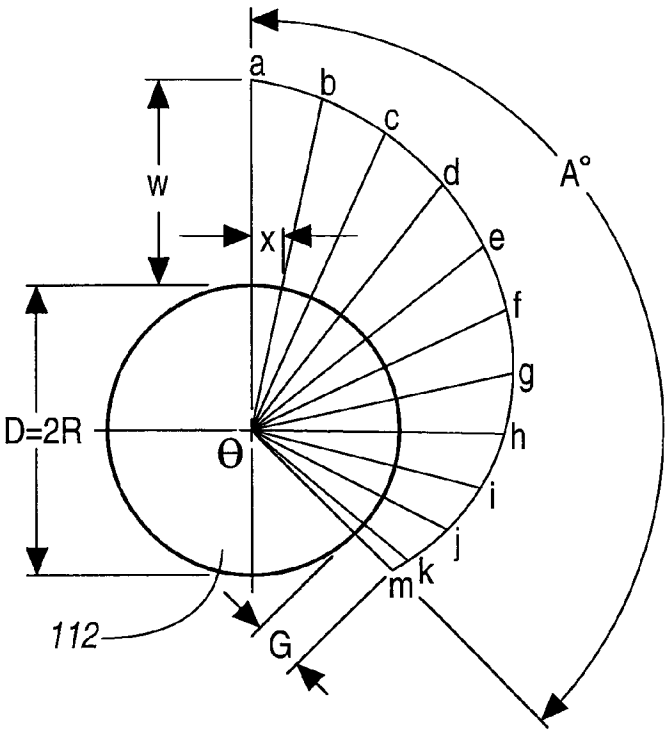
FIG. 3C illustrates that a combination of FIGS. 2, 3A and 3B determine the curve ("reaction surface") of the jaw.
Figure 3B:
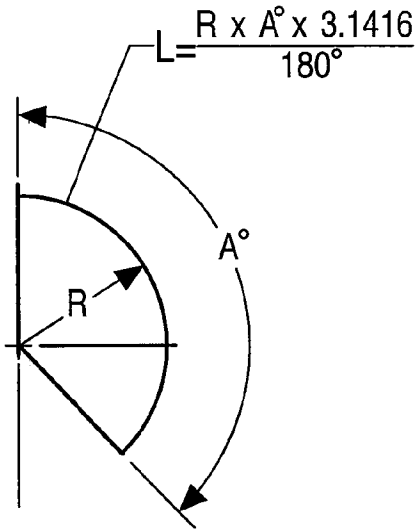
FIG. 3B depicts the relationship geometrically between the radius of the roll (R), an arcuate angle (A) and the calculated length (L) of the reaction surface of the jaw.
Figure 3A:
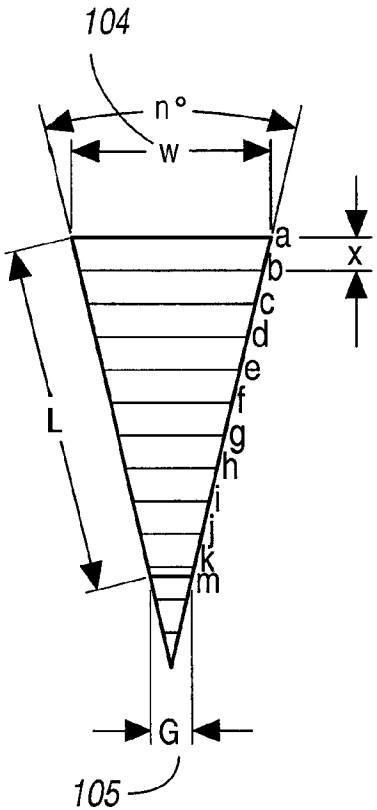
FIG. 3A shows a given nip angle n° in which W represents the average feed size of incoming material and G represents the average size of discharged material.

In FIG. 3A:

W=the average diameter of rock to be crushed as input material 104;

n° is the nip angle (i.e. the included angle between two opposing surfaces whereby an object—such as a stone aggregate—is in point contact for compression by the two surfaces and will either be forceably ejected outwardly and away from the opposing surfaces when the included angle is increased or maintained in compression and eventually crushed when the included angle is reduced);

L=the length of the curve that characterizes the reaction surface 110;

A°=the arcuate length of the curved jaw or reaction surface 110. (The angle A is preferably about 135 degrees);

G=the average output particle size 105;

R=the radius of the crushing roll 112; and

D=the diameter of the crushing roll 112.

The combination of normal (N) and tangential (T) forces produces a resultant vector (R). Incoming material is subjected to a resultant of forces (R) that is about 95% in tension and about 5% in compression.

FIG. 3B illustrates the relationship between the radius of the roll (R), the angle A and the length of jaw (L). The formula shown in FIG. 3B enables the length of the jaw (L) to be calculated for a given roll radius (R) and angle A. Conversely, for given values of L and A, an optimum roll radius (R) can be calculated.

FIG. 3C defines how the combination of FIGS. 2, 3A, and 3B determine the characteristics of the jaw. As the input material 104 enters the feeder 106, it is exposed to a progressively narrowing space. The dimensions (chords) of the progressively narrowing space are characterized by the letters a, b, . . . k, m (FIGS. 3A, 3C). Together, the chords a, b, . . . k, m emanate from an imaginary center [O] of the crushing roll 112. In the model shown (FIGS. 3A-C), the chord lengths describe the reaction surface 110 as they sweep through an angle of A degrees.

A desirable "nip angle" (n) controls the ability to crush a given type of material or rock at a commercial rate. This preferably falls between 17 and 27 degrees. When R is directed inwardly, the force vectors tend to draw material further into the crushing zone for comminution and further crushing action. Without the proper nip angle for a given rock type, the crusher will have large inefficiencies. If this ideal range is exceeded, input material tends to be regurgitated from the machine, like popcorn from a popcorn machine. Below the desired range, the machine serves more as a grinder, which diminishes throughput and adds to the amount of undesirable dust and fine material that is generated.

Under gravitational influence, material tends to be expelled upwardly from the crushing zone between the reaction surface 110 and the crushing roll 112 tends to return to the crushing zone if the nip angle lies within the preferred range and the geometry of the machine with respect to gravity is correct.

In general, the selected nip angle (n°) is based upon a variety of physical properties of the material, such as but not limited to its compressive and tensile strength, co-efficient of friction against the jaw and roll, angular repose of loose input material, specific gravity, modulus of elasticity, and fracture characteristics.

A range of nip angles is optimized by physical compressive lab testing of different rock types to minimize power requirements. This yields an appropriate angle of n degrees in FIG. 3A for a given rock compressive strength.

In FIG. 3B a roll diameter of radius (R) is selected with a given sweep of the jaw (angle A—preferably about 135 degrees).

FIG. 3C takes a desired discharge size (G) at a chord (m) to indicate the actual discharge point of the crusher jaw. By rolling the desired nip angle (n°) in FIG. 3A around the roll angle of A degrees in FIG. 3B, the result is the most efficient jaw curvature (outlined in FIG. 3C). Thus, the calculated roll and jaw configuration yield the minimum horsepower requirement for crushing.

Without wishing to be bound by any particular theory, it appears that incoming material is first subjected to compressive forces. Subsequently, bending force vectors tend to subject the material to tensile forces. These in part are caused by a second revolution of the eccentric shaft which constricts the aperture (formed by two surfaces—the roll and the jaw—of different radii) through which the initially crushed rock passes. Unlike most prior approaches, minimal or no recompression occurs.

In general, under given operating conditions and materials, harder, brittle material is optimally crushed when the nip angle is toward the lower end of the angular range between 17 and 27 degrees. Softer material tends to be optimally crushed when the nip angle is toward the higher end of the angular range.

Figure 4:
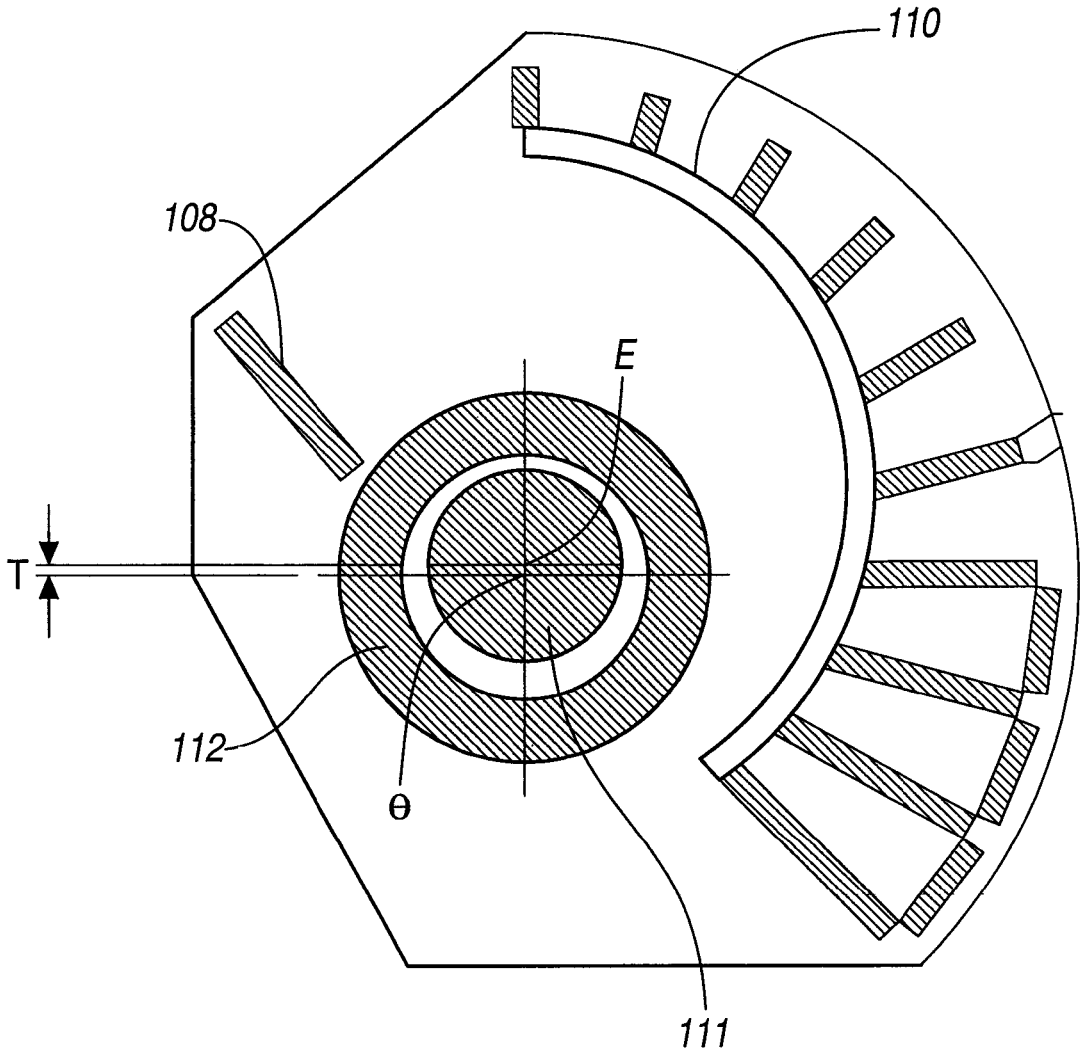
FIG. 4 is a sectional view through a crushing roll and an eccentric shaft, illustrating their positioning in relation to a hopper and the reaction surface of a jaw assembly.

In FIG. 4, the origin (O) represents the an axis of symmetry of the crushing roll 112. The imaginary center line (O) of the crushing roll is displaced from the rotational axis (E) of an eccentric shaft 111. The displacement T between E and O is illustrated. T represents half of the total offset or throw of the eccentric shaft or eccentric rolling element 111 as it rotates through 360°. This feature permits a comparatively minimal amount of structural support, entails low prime-mover horsepower requirements and significantly reduces machine size and cost. Further, less waste is produced as a result of the crushing process. Thus, the total amount of throw is twice the amount of eccentricity (T). Preferably, T lies between about one-eighth of an inch and about one-half of an inch.

The assembly and components of the core crushing unit 10 will now be described with primary reference to FIG. 5. In that figure, there is an exploded view of the rock crushing assembly 10. An eccentric shaft 11 may have an internal eccentric counterweight design that eliminates external eccentric counterweights which are traditionally located at the outward end of a main eccentric shaft. In one embodiment, the eccentric shaft 11 has weight removed through a machining operation, based upon the mass of the eccentric shaft 11, the crushing roll 12, and other design considerations. This internal eccentric weight reduces the overall mass of the core crushing assembly 10 and reduces vibration in the machine, while eliminating the need for bulky, exterior guards.

The eccentric shaft 11 is insertable within the hollow crushing roll 12. Conventionally, internal bearings 13, one or more washers 21 and one or more internal seals 14 cooperate with one end of the eccentric shaft 11. Eccentric bearing housings 15, exterior bearing 16, one or more bearing seals 17, an exterior bearing cap 18, a motor mount 19, and a drive 30 also engage a first end of the eccentric shaft 11. Thus, eccentricity is provided between the exterior bearing 16 and the internal bearing 13.

Figure 5:
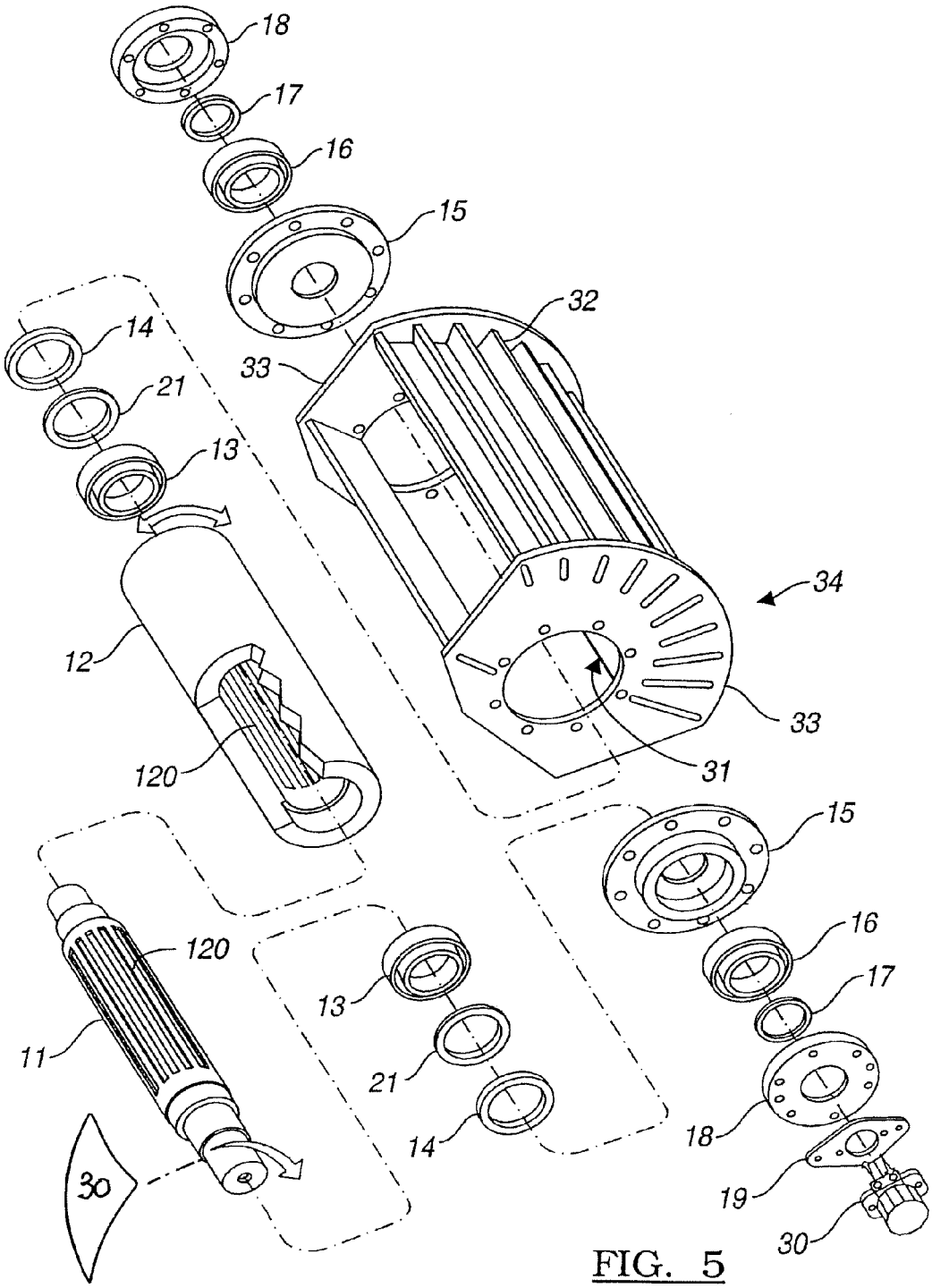
FIG. 5 is an exploded view of the several component parts of the machine depicted in FIG. 4.

The drive 30 is preferably an hydraulic drive that may receive hydraulic fluid in the direction of the arrows shown in FIG. 5. Alternatively, the flow of hydraulic flow may be opposite from that depicted. One attribute of the concentric hydraulic drive 30 is that there are no moving parts outside the assembly. This has a desirable effect on safety and eliminates the use of guards that might otherwise be needed to protect the operator.

At a second end of the eccentric shaft 11 there is provided one or more internal bearings 13, one or more washers 21, one or more internal seals 14, an eccentric bearing housing 15, an exterior bearing assembly 16, one or more exterior bearing seals 17, and an exterior bearing cap 18.

In the embodiment shown in FIG. 5, a first set of one or more grooves is formed in the mid section of the outer surface of the eccentric shaft 11. Likewise, a second set of one or more grooves or vanes are provided in the mid section of the inner surface of the crushing roll 120. Each of these sets of grooves is in close rotational proximity when the machine is in its assembled state and ready for operation. The one or more grooves can be longitudinally oriented, formed as a spiral, or disposed in a herringbone-type of pattern.

Preferably, the grooves in the outer surface of the eccentric shaft 11 are provided on only one side of the eccentric shaft. The grooves or vanes or fins may still be provided continuously on the inner surface of the roll 120. Unequal mass distribution of the eccentric shaft about its rotational axis tends to serve as a counterweight and tends to reduce unwanted vibration in the crushing roll-shaft subassembly.

A viscous fluid, such as hydraulic oil for example, is contained within the cavity between the sets of grooves. The purpose of the viscous fluid is to transmit at least a portion of rotational energy or torque biasing from the eccentric shaft 11 to the roll 12. Thus, the roll 12 may rotate or lope in approximate unison with the eccentric shaft 11 when no crushing action is taking place. When crushing begins, the combination of drive torque biasing and the rotating mass-inertia of the roll 12 provide a combination of forces that is desirable toward the efficient throughout and crushing action of the device. When a temporarily heavy crushing force event is encountered between the jaw reaction surface 110 and the roll 12, the slipping action of the torque biasing means 120 allows the roll 12 to temporarily stop or even reverse rotation temporarily until the heavy crushing action is completed. The roll 12 may then resume its bias direction of rotation with the eccentric shaft 11 under lighter loads.

The roll drive torque biasing drive mechanism 12 is not limited to the viscous fluid coupling described in the example above. Other means of drive couplings may also be used, such as a design having an automotive-type torque converter where an impeller, stator, and turbine may be used to produce the desired roll drive torque characteristics for this invention. As used herein, the term "torque converter" generally should be construed to include any torque transmitting device, including, but not limited to, those listed in the previous sentence. In addition, a magnetic-type brake-drive coupling device using either permanent or electronically controlled electro-magnets may be used to produce the desired roll drive torque characteristics for this invention.

Figure 6:
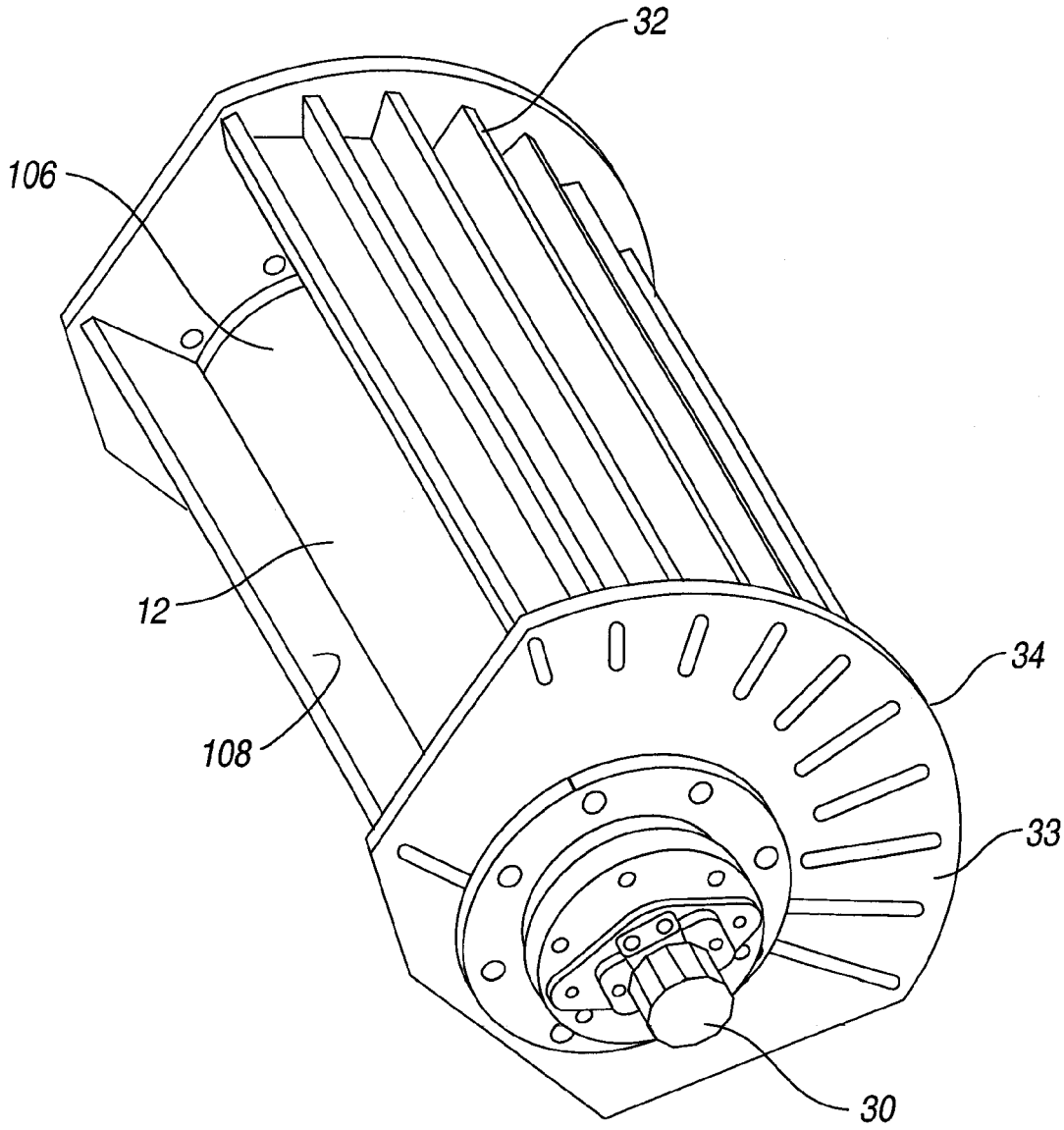
FIG. 6 is a quartering perspective of the rock crushing assembly constructed in accordance with the present invention.

The eccentric shaft and the components described thus far together comprise a subassembly which is located within a jaw wear plate 31, a jaw gusset plate 32, a main side plate 33, and a gusset support plate 34. Upon insertion of the subassembly, the core crushing assembly 10 resembles that depicted in the quartering perspective view of FIG. 6.

Figure 7:
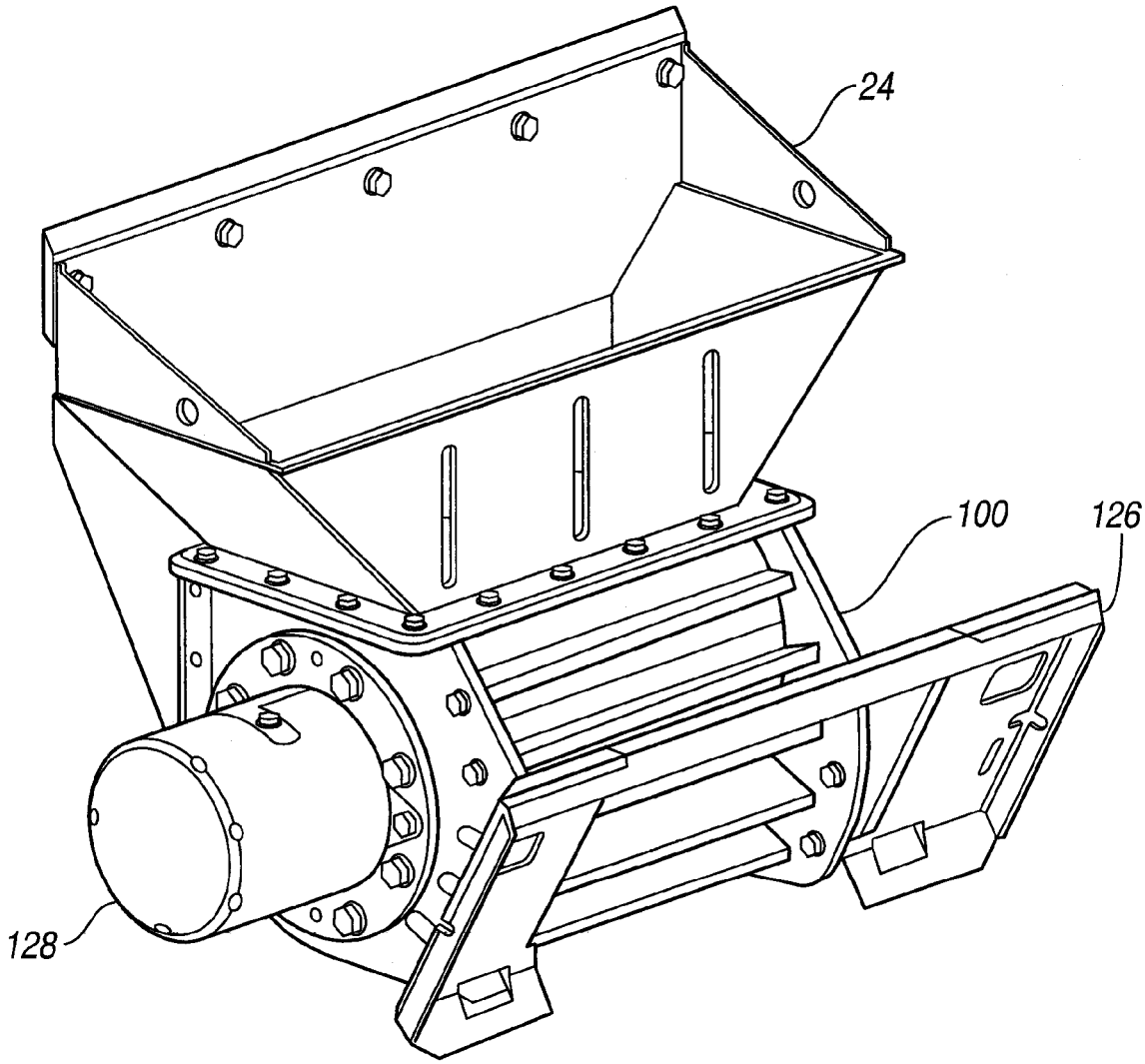
FIG. 7 is a depiction of the rock crusher according to the present invention, shown with a bucket, an attachment plate, and a motor cover.

FIG. 7 is a quartering perspective view of a rock crushing machine 100 to which is attached a hopper/bucket 124, an attachment plate 126, and a drive motor guard or cover 128. It should be understood that conventionally, the term "bucket" refers to a mobile piece of equipment. The term "hopper" generally is fixed. Typically, a bucket that contains material to be crushed may be moved, for example, by a conveyer, to a hopper into which the bucket's contents may be emptied. The attachment plate 126 allows quick coupling to any vehicle such as a loader, skid steer, backhoe, excavator, or Bob Cat. As illustrated, the bucket 124 can be readily attached to or detached from the rock crushing machine 100. Thus, any desired configuration of hopper or bucket can be used. Indeed, the operator can use his own hydraulic power plant, in which case a hopper is deployed, rather than a bucket.

The motor cover or guard 128 is effectively a round cover which is mounted on an end of the rock crushing machine 100. It covers and protects the drive unit 30. As a result, there are no moving parts outside the rock crushing machine 100, thereby dispensing with the need for any guards that would otherwise be required to protect an operator. In one embodiment, the motor cover 128 is about 7 inches long and six inches in diameter.

The invention thus includes a roll drive torque biasing mechanism 120. The torque biasing mechanism 120 (FIG. 5) allows a relative degree of slippage to occur between the roll 12 (driven member) and the eccentric shaft 11 (driving member). When viewed from either end, the eccentric shaft 11 may have grooves or vanes inscribed over less than 360° of its circumference. In this embodiment, an imbalance is created when the eccentric shaft rotates. Such an imbalancing feature usefully serves to counteract the noise and vibration that results from engagement by a viscous fluid between the eccentric shaft (driving member) and crushing roll (driven member).

It will be appreciated that the torque converter mechanism 120 includes a fluid-coupling device that also acts as a torque multiplier during initial acceleration. This combination of roll forces and movement enhances the throughput of the crushing apparatus, since any material that is in contact with the roll 12 will tend to be driven through the machine and expelled more quickly than if the roll 12 tended to remain in a condition of non-rotation, reversed rotation, or even random rotation. As mentioned earlier, it is desirable that whenever crushing forces may require it, the roll 12 is able to temporarily reverse direction on its own to accommodate the ideal crushing action forces within the apparatus. The rotating mass-inertia of the roll however, is a factor in the ability of the roll to reverse direction too quickly in response to smaller forces, thus maintaining throughput and efficiency.

It has been found that the curved path followed by the input material 104 causes a greater proportion of the rock to crush in tension. This results in a product size distribution that has fewer fines—typically, it has been found that fine output is reduced from about 27% to about 7%. Although the results may vary, about 20% of useful product results by following the teachings of the present invention, in comparison to prior art approaches using the same amount of rock. This results in operating cost reductions because storage costs associated with waste material (fines) are minimized or eliminated.

Dangerous and cumbersome manual cleaning and removal of material jams is virtually eliminated by deployment of the present invention because the design disclosed has an anti-jamming or auto-reversing feature of the eccentric shaft and roll that rapidly clears material jams without damage to the machine or the operator. If a jam occurs, the relatively small size and portability of the rock crushing unit enables it readily to be inverted, the direction of rotation reversed, and then unwanted jamming material can readily be expelled from the machine.

Accordingly, the invention includes a jaw fixture that opposes a crushing roll which also serves as a feeder. Together, these components cooperate similarly to a peristaltic pumping action, in which rock is lifted into the crushing zone.

Using the disclosed invention provides for ease of on-site mineral exploration and demolition material crushing. Its low-profile operation and durability of this invention offers numerous advantages. The lightweight design curtails haulage and offsite crushing by facilitating crushing on-site; by bringing the crusher to the rocks, time, energy, and transportation overhead are reduced.

Additionally, this invention also provides narrow openings or one or more viewing apertures that can be provided in the hopper. These viewing apertures allow the operator to more easily see the input material moving into the machine.

Preferably, the hydraulic drive 30 propels the eccentric shaft 111 at the speed of about 20-100 rpm, and preferably about 200-600 rpm. If too fast, the resulting action is akin to mashed potato in a speeding whipping blender. Preferably, hard materials (such as granite) are subjected to a eccentric shaft rotation speed of about 200 rpm, while soft material are more optimally processed by a rotation speed of about 300-400 rpm. Other things being equal, input material that is generally round can be processed at rotation speeds between about 350-400 rpm; while more angular types of input material are more efficiently processed at rotation speeds between about 400-600 rpm. Typical horsepower consumption in the disclosed crusher may be as low as 10 HP.

By using the present invention, production ratios of about 5:1 can be realized. In practice, if a sidewalk is to be broken up, each flagstone may measure about 4'×4'×5" in thickness. When broken down the middle, each half measures about 4'×2'×5". The 2' edge may be inserted into one embodiment of the crusher constructed according to the present invention. The resulting output material may have an average size of about 1 inch.

Figure 8:
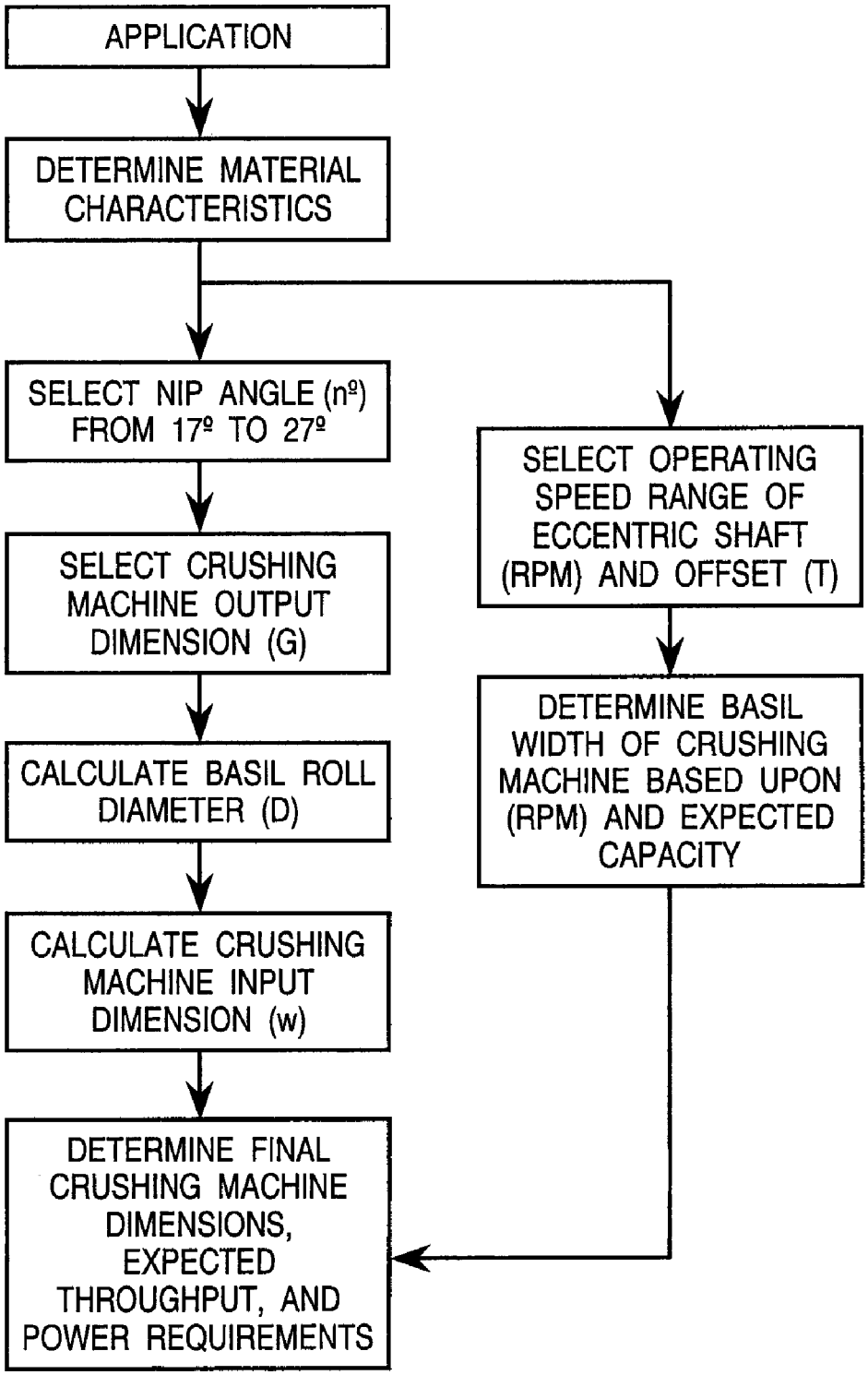
FIG. 8 is a process flow diagram illustrating the main steps involved in designing the disclosed apparatus and practicing the method described herein.

FIG. 8 is helpful in summarizing the main process steps followed in designing the disclosed apparatus.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A rock crushing machine comprising;

a base;

a jaw assembly secured to the base, the jaw assembly being adapted to receive rock as input material to be at least partially crushed, the jaw assembly having an arcuate reaction surface that progressively engages the input material;

a hollow crushing roll having an axial inner chamber that has an axis of symmetry (O), the crushing roll being a driven member having an outside surface that forms a crushing zone between it and the reaction surface of the jaw assembly;

an eccentric shaft serving as a driving member that is positioned at least partially within the crushing roll, the eccentric shaft having an axis of rotation (E), the axis (E) being displaced from the axis (O) by a distance (T);

a torque transmitting device positioned between the eccentric shaft and the crushing roll; and a drive mechanism that is coupled to the eccentric shaft, so that as the eccentric shaft turns, at least a portion of rotational forces are transmitted to the crushing roll by the torque transmitting device, one or more grooves being provided in an outer surface of the eccentric shaft and one or more grooves being provided within the axial inner chamber of the hollow crushing roll, the torque transmitting device including fluid that serves to transmit rotational forces between the longitudinal grooves of the eccentric shaft and those of the crushing roll, the torque transmitting device including a fluid that is viscous and transmits at least a portion of rotational energy from the eccentric shaft to the roll so that the roll may rotate with the eccentric shaft when no crushing action is taking place, and so that when crushing begins, a combination of drive torque biasing and the rotating mass-inertia of the crushing roll provide forces that promote efficient crushing action and so that when a heavy crushing force event is encountered between the jaw reaction surface and the crushing roll, slippage of the torque transmitting device allows the crushing roll to temporarily stop or reverse rotation until the heavy crushing action is completed.

2. The rock crushing machine of claim 1 wherein the eccentric shaft has an internal eccentric counterweight that reduces vibration in the rock crushing machine.

3. The rock crushing machine of claim 1 wherein the grooves that are provided on the eccentric shaft are disposed along less than 360° of the eccentric shaft's outside surface when viewed along its axis of rotation (E) so that the eccentric shaft may rotate and tend to offset vibration created by the crushing roll as it rotates.

4. The rock crushing machine of claim 1 wherein the torque transmitting device is a device selected from the group consisting of an impeller, stator, turbine, a magnetic-type brake-drive coupling device, friction brake, and electronically controlled electro-magnetics.

5. The rock crushing machine of claim 1 further including a bucket attached to the jaw assembly.

6. The rock crushing machine of claim 5, wherein the bucket can be readily attached to or detached from the machine.

7. The rock crushing device of claim 1 further including an attachment plate for coupling the rock crushing machine to a vehicle.

8. The rock crushing machine of claim 1 further including a bucket and an attachment plate.

9. The rock crushing machine of claim 1 further including a viewing aperture provided in a hopper that receives input material before delivery to the jaw assembly.

10. The rock crushing machine of claim 9, wherein the viewing aperture comprises one or more narrow and vertical slots within a side wall of the hopper, so that the operator can view the progress through and quantity of material in the hopper.

11. The rock crushing machine of claim 1 wherein the drive mechanism propels the eccentric shaft at a speed of about 20-1000 rpm.

12. The rock crushing machine of claim 1 wherein the arcuate reaction surface of the jaw assembly describes an angle of about 135°.

13. The rock crushing machine of claim 1, wherein the drive mechanism includes a hydraulic drive that receives pressurized fluid from a source that is external to the machine, thereby enhancing the portability and packaging of the machine.

14. A rock crushing machine comprising;

a base;

a jaw assembly secured to the base, the jaw assembly being adapted to receive rock as input material to be at least partially crushed, the jaw assembly having an arcuate reaction surface that progressively engages the input material;

a hollow crushing roll having an axial inner chamber that has an axis of symmetry (O), the crushing roll being a driven member having an outside surface that forms a crushing zone between it and the reaction surface of the jaw assembly;

an eccentric shaft serving as a driving member that is positioned at least partially within the crushing roll, the eccentric shaft having an axis of rotation (E), the axis (E) being displaced from the axis (O) by a distance (T);

a torque transmitting device positioned between the eccentric shaft and the crushing roll;

a drive mechanism that is coupled to the eccentric shaft, so that as the eccentric shaft turns, rotational forces are transmitted to the crushing roll by the torque transmitting device wherein one or more grooves are provided in an outer surface of the eccentric shaft and one or more grooves are provided within the axial inner chamber of the hollow crushing roll, the torque transmitting device including a viscous fluid that transmits at least a portion of rotational energy from the eccentric shaft to the roll so that the roll may rotate in approximate unison with the eccentric shaft when no crushing action is taking place, and so that when crushing begins, a combination of drive torque biasing and the rotating mass-inertia of the crushing roll provide forces that promote efficient crushing action and so that when a temporary heavy crushing force event is encountered between the jaw reaction surface and the crushing roll, a slipping action of the torque transmitting device allows the crushing roll to temporarily stop or reverse rotation until the heavy crushing action is completed.

* * * * *